US007845424B1

(12) United States Patent
Miller

(10) Patent No.: US 7,845,424 B1
(45) Date of Patent: Dec. 7, 2010

(54) PACKAGED RESIDENTIAL FIRE SPRINKLER PUMP SYSTEM

(76) Inventor: Peter C. Miller, 5303 Weetman St., Burke, VA (US) 22015

( * ) Notice: Subject to any disclaimer, the term of this patent is extended or adjusted under 35 U.S.C. 154(b) by 273 days.

(21) Appl. No.: 12/149,791

(22) Filed: May 8, 2008

Related U.S. Application Data

(60) Provisional application No. 60/924,302, filed on May 8, 2007.

(51) Int. Cl.
*A62C 35/00* (2006.01)

(52) U.S. Cl. ..... 169/13; 169/67

(58) Field of Classification Search ..... 169/13, 169/16, 51, 52, 65, 67; 239/349, 124, 146, 239/148
See application file for complete search history.

(56) References Cited

U.S. PATENT DOCUMENTS

| | | | | |
|---|---|---|---|---|
| 1,421,433 | A | 7/1922 | Epps | |
| 3,179,181 | A | 4/1965 | Banzato | |
| 3,866,687 | A * | 2/1975 | Banner | 169/61 |
| 4,330,040 | A | 5/1982 | Ence et al. | |
| 4,330,412 | A * | 5/1982 | Frederick | 210/805 |
| 4,366,865 | A | 1/1983 | Makibbin | |
| 4,428,434 | A | 1/1984 | Gelaude | |
| 5,113,944 | A | 5/1992 | Nakagawa et al. | |
| 5,125,458 | A | 6/1992 | Berman | |
| 5,732,511 | A | 3/1998 | Scott | |
| 5,909,983 | A | 6/1999 | McGee, Jr. | |
| 5,979,563 | A | 11/1999 | Fritz | |
| 6,004,133 | A | 12/1999 | Harrison, III | |
| 6,450,264 | B1 | 9/2002 | Christian | |
| 6,648,077 | B2 | 11/2003 | Hoffman | |
| 6,857,478 | B1 | 2/2005 | Weber | |
| 7,017,865 | B2 | 3/2006 | Zearbaugh | |
| 2003/0052770 | A1 | 3/2003 | Mansfield, Jr. et al. | |
| 2005/0145396 | A1 | 7/2005 | Treddenick | |
| 2005/0183868 | A1 * | 8/2005 | Taylor et al. | 169/51 |

* cited by examiner

*Primary Examiner*—Davis Hwu
(74) *Attorney, Agent, or Firm*—Miles & Stockbridge P.C.; Eric G. King

(57) ABSTRACT

A packaged residential fire pump system for sprinkler protection of one- and two-family dwellings. The system independently provides sufficient water pressure, and volume, for a two sprinkler flow for a period of time. An existing domestic water supply is supplemented with a dead water storage tank. The system can be combined with hydraulically sized, or scheduled, system piping and sprinkler heads.

17 Claims, 5 Drawing Sheets

1 PUMP / MOTOR ASSEMBLY
2 CONTROLLER ASSEMBLY
3 TANK ASSEMBLY
4 CONTROL PIPING
5 SUPPORT FRAME

1 PUMP / MOTOR ASSEMBLY
2 CONTROLLER ASSEMBLY
3 TANK ASSEMBLY
4 CONTROL PIPING
5 SUPPORT FRAME

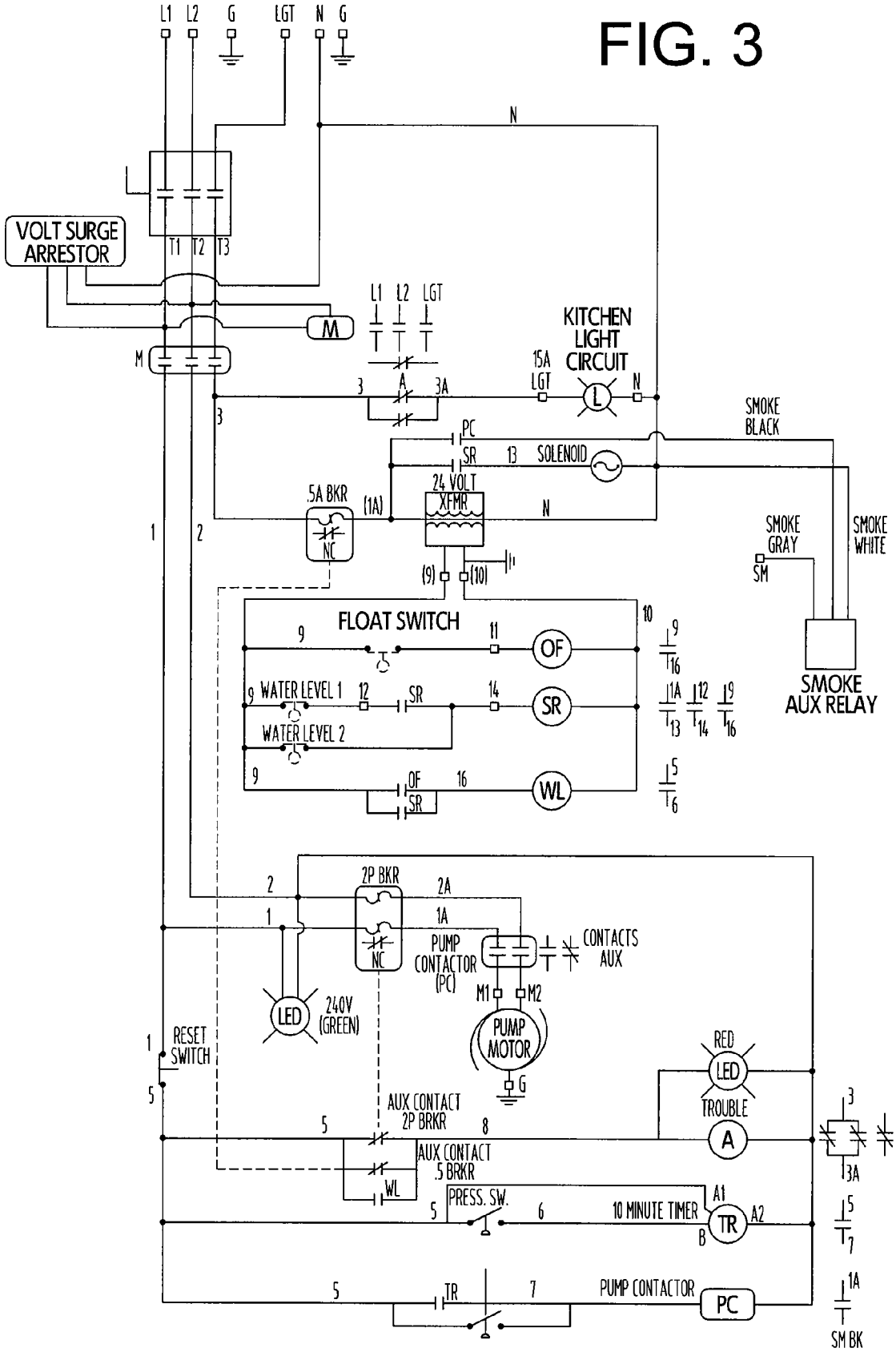
FIG. 3
L1 L2 G LGT N G
N
VOLT SURGE ARRESTOR
T1 T2 T3
M
L1 L2 LGT
KITCHEN LIGHT CIRCUIT
15A LGT
L
N
3 A 3A
PC
SR 13 SOLENOID
SMOKE BLACK
.5A BKR
NC
(1A)
24 VOLT XFMR
N
SMOKE GRAY
SM
SMOKE WHITE
(9) (10)
FLOAT SWITCH
9 11 OF
WATER LEVEL 1 12 SR 14 SR
WATER LEVEL 2
9 OF SR 16 WL
SMOKE AUX RELAY
2P BKR
2A
1A
NC
PUMP CONTACTOR (PC)
CONTACTS AUX
M1 M2
PUMP MOTOR
G
LED
240V (GREEN)
RESET SWITCH
RED LED
TROUBLE
A
AUX CONTACT 2P BRKR
AUX CONTACT .5 BRKR
WL
PRESS. SW.
10 MINUTE TIMER
A1 A2 B
TR
TR
PUMP CONTACTOR
PC
SM BK

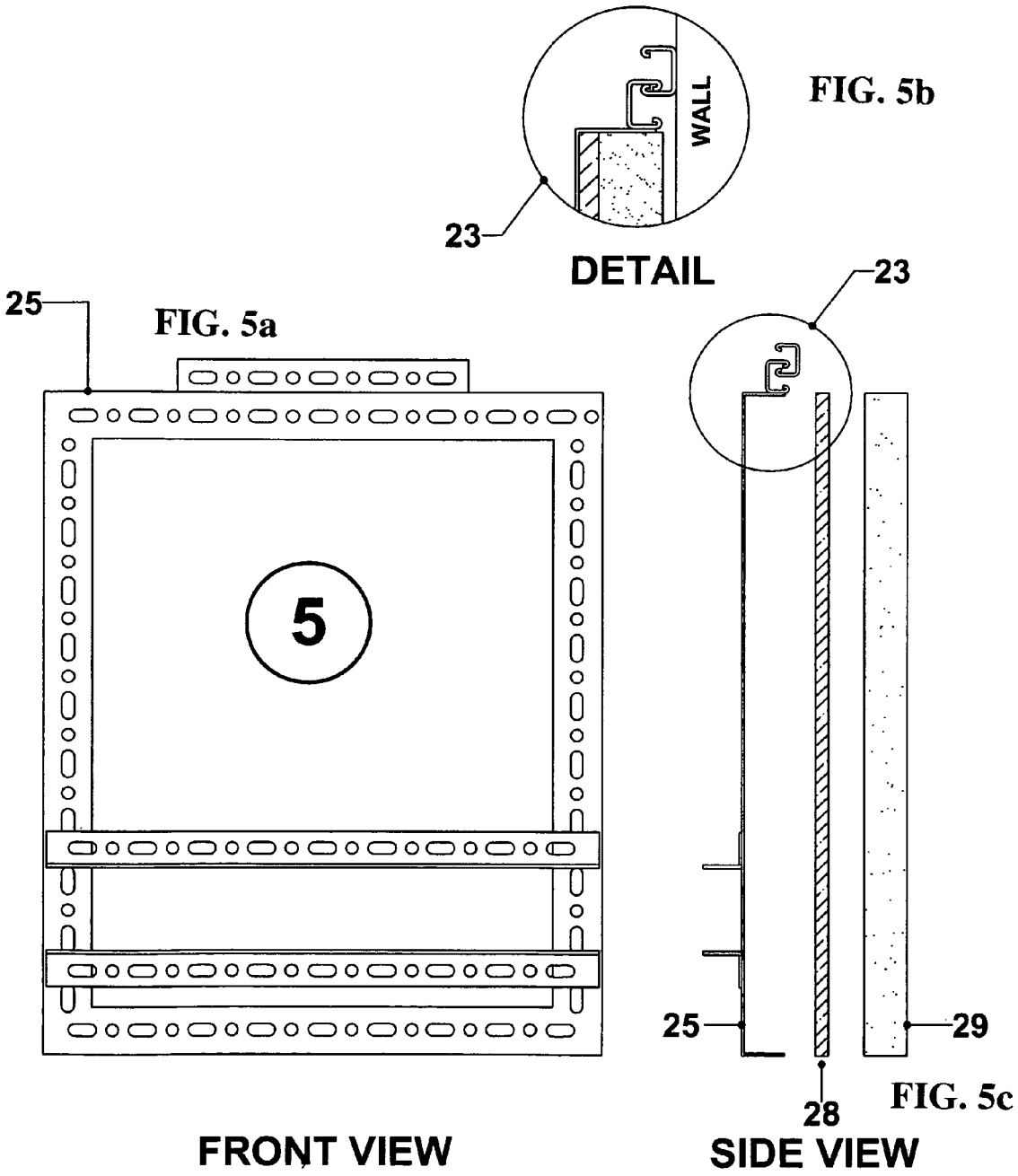
FIGS. 5a-c

PACKAGED RESIDENTIAL FIRE SPRINKLER PUMP SYSTEM

This application claims the benefit of U.S. Provisional Application No. 60/924,302, filed May 8, 2007, which is hereby incorporated by reference in its entirety.

BACKGROUND

1. Field of Invention

The present invention relates generally to fire control, and, more particularly, to systems and methods for residential fire sprinkler systems.

2. General Background

The National Fire Protection Association, Standard for the Installation of Sprinkler Systems in One- and Two-family Dwellings and Manufactured Homes (NFPA 13D) 2007 edition, establishes standards for fire sprinkler protection of residential dwellings, including water supply requirements. In some cases the existing water supply can provide a sufficient volume of water but not at a pressure necessary to meet the sprinkler demand required by NFPA 13D. In these cases the existing water supply for the residential fire sprinkler system can utilize pressure elevation through the use of a pump. In other cases, the existing water supply can be deficient in both the volume and pressure required by NFPA 13D. In these cases, the packaged residential fire sprinkler pump system can include the addition of a water storage tank.

BRIEF DESCRIPTION OF THE DRAWINGS

The invention claimed and/or described herein is further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIG. 3 is an electrical schematic diagram of the operational logic of the packaged residential fire pump system in accordance with various embodiments;

FIGS. 5*a* through 5*c* are a front, left side, and detail views, respectively, of a support frame assembly, insulation package, and mounting assembly for the residential fire pump system in accordance with various embodiments.

SUMMARY

Figure 1:
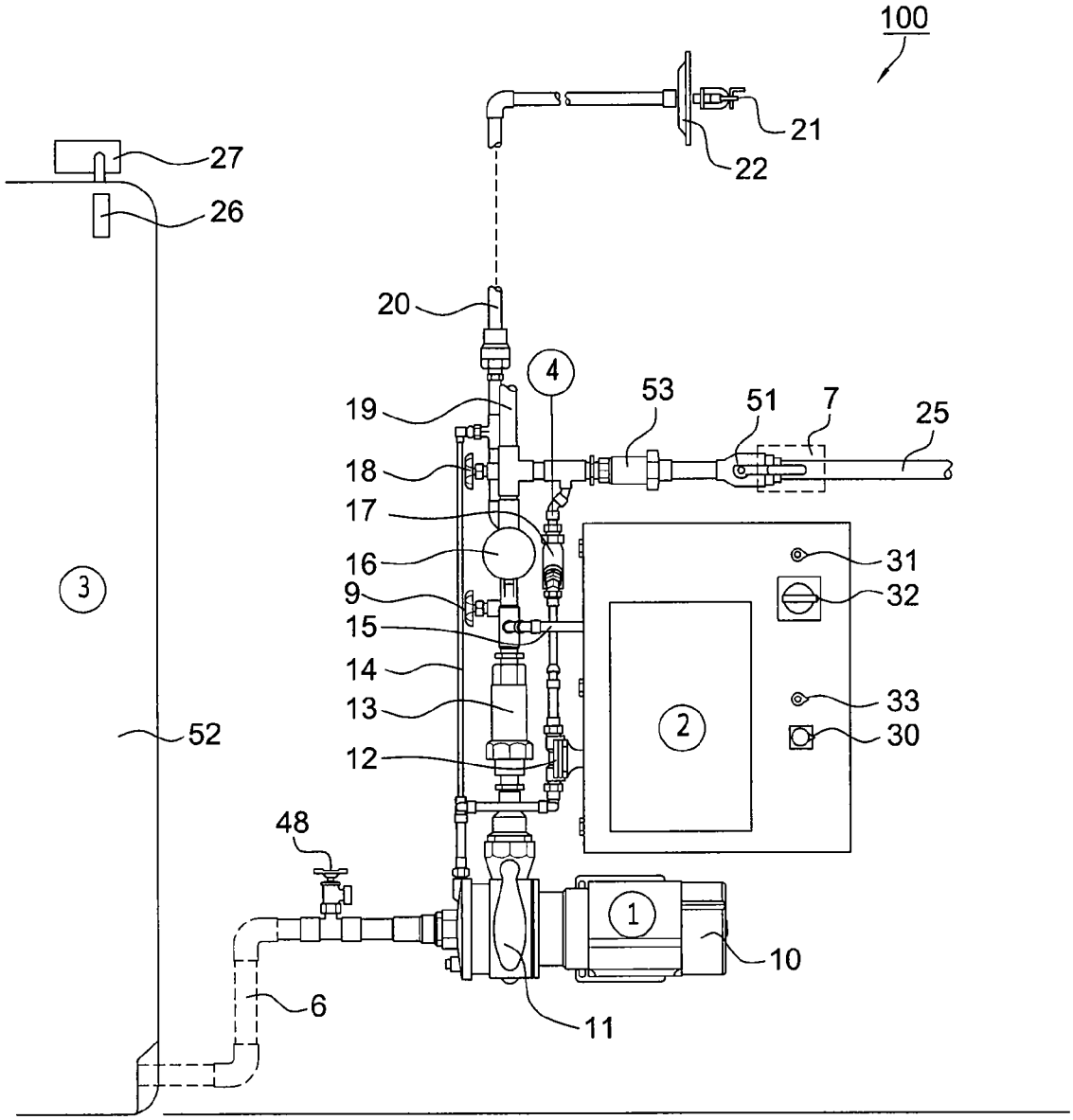
FIG. 1 is a front view of a packaged residential fire pump system with a typical connection to a domestic water system, in accordance with various embodiments.

Embodiments of the present invention relate to a packaged residential fire pump system designed to supplement or replace existing water supplies for fire sprinkler protection of one- and two-family dwellings. According to various embodiments, the system can contain all features required for an automatic operation after sprinkler activation, or during a system test. Prior systems have been designed and constructed in a manner that could easily be disabled, either deliberately or inadvertently. Such prior systems also lack other features such as operational supervision of critical mechanical and electrical functions, and are difficult to functionally test. Embodiments of the present invention overcome these deficiencies by eliminating water control valves, and integral motor thermal overload devices, and adding supervision of electrical controls, and providing a simple means for flow testing. In various embodiments, a pre-engineered system design can eliminate most calculations previously required to hydraulically design a residential sprinkler system including: Water supply, system elevation, meters, backflow devices, piping, and fitting friction loss calculations, and sprinkler operating pressure. In various embodiments, these calculations can be replaced with a scheduled piping layout using sixteen (16) foot fire sprinkler head spacing.

DETAILED DESCRIPTION

Embodiments are directed generally to a system for residential fire sprinkler control. For example, various embodiments can include a packaged residential fire sprinkler pump system having a fire sprinkler controller assembly operably coupled to an existing water and electrical supply, a fire sprinkler pump/motor assembly operably coupled to existing water and electrical supplies, a system control piping assembly for operation and maintenance of the fire sprinkler pipe system, and a welded support frame assembly supporting the pump/motor assembly, the controller assembly, and the control piping assembly. The support frame can be constructed for wall mounting using an interlock assembly.

The fire sprinkler controller assembly can further include a system three pole rotary disconnect, a motor disconnect, and an external control circuit breaker whose position is electrically supervised using a plurality of contacts and relays configured to supervise system critical functions, including to output a first trouble signal when said external control circuit breaker is in an off position, to output a second trouble signal upon loss of power in any phase, and to output a third trouble signal upon high or low water level thresholds being exceeded, in which each said trouble signal can be operably coupled to a red Light Emitting Diode (LED) and a kitchen lighting circuit such that output of any of said trouble signals causes the red LED to be illuminated and de-energizes the kitchen lighting circuit.

The fire sprinkler controller assembly can further include a transformer that provides a safe low voltage control for a tank float control circuit, a momentarily closed motor stop switch constructed to return the system a fully automatic mode after testing, a NEMA type two enclosure sized to contain all control components and including a hinged door with a black quarter turn latch, in which the enclosure is powdered coated with a red texture finish, a fixed system timer configured to provide uninterrupted pump/motor operation for a minimum duration such as, for example, 10 minutes, and a parallel control circuit configured to allow system operation in the event of timer failure or removal.

According to various embodiments, the pump/motor assembly can further include a stainless steel multi-stage centrifugal pump operably coupled to a one and one-half horsepower totally enclosed fan cooled motor designed to operate using a single phase 230VAC power source.

According to various embodiments, the control piping assembly can further include a one-inch piping outlet supplying water to a sprinkler system, a drain/test assembly for testing system readiness and constructed to allow water flow through a slow closing gate valve to an open sprinkler having its operating element retaining screw removed, the open sprinkler being threaded into a single outlet half-inch white rectangular cluster cover mounted on an exterior of a dwelling using brick insert screws or a small plastic siding box, and a one-quarter inch circulation line constructed to allow a cooling water flow through the test/drain assembly when the pump is operating against a closed system. The circulation line can be further configured to automatically prime the pump during set-up.

The control piping assembly can further include a pressure gauge that provides static and residual readings of sprinkler system pressure during operation, a pressure switch operably connected to the controller assembly and configured to sense system pressure drop and to close a control circuit upon sprinkler activation or in response to operation of the test valve, and a half inch threaded valve with a plug on a lanyard to allow access for hydrostatic testing of system piping.

According to various embodiments, the support frame assembly can further include a mounting frame assembly connecting the pump/motor, controller assembly, and system control piping assembly to a welded frame constructed from minimum fourteen gauge slotted angle stock having dimensions of two and one-half inch by one and one-half inch and primed and painted red to resist corrosion. The support frame assembly can further include an interlocking wall mounting system constructed of two pieces of thirteen-sixteenth inch steel strut and configured for mounting the frame on a wall. The mounting frame assembly can be designed to allow for installation of an R-13 insulation barrier and a thermal barrier between a mounting surface and wetted components of the packaged residential fire sprinkler system to prevent freezing of the control piping assembly and to provide insulation values required by energy codes on exterior walls.

According to various embodiments, the packaged residential fire sprinkler control system can further include a water storage tank operably coupled to the fire sprinkler controller assembly, an existing water supply, and one or more existing electrical power supplies. The water storage tank can include a non-corrosive, translucent polyethylene shell designed to be non-corrosive constructed to allow a visible indication of a water level, a tank fill system comprising an electrically operated solenoid water valve controlled by a float assembly and configured to provide automatic refilling of the tank and indication of high/low water levels, and a half inch drain valve terminating with male three-quarter inch National Hose Thread and sealed with a threaded plastic cap provided in a tank discharge line for tank draining, said drain valve further configured to provide a source of sanitation water.

In particular with respect to FIG. 1, there is shown a packaged residential fire pump system 100 in accordance with various embodiments. As shown in FIG. 1, the packaged residential fire pump system 100 can include pump/motor assembly 1, a controller assembly 2, control piping 4, and a support frame 5 (see FIGS. 5*a-c*). In FIG. 1, the support frame 5 has been removed for clarity. The pump/motor assembly 1 can connect to a tank assembly 3 tank supply 6 via a tank drain valve 48.

Packaged Residential Fire Pump System—Pump/Motor Assembly

As shown in FIG. 1, according to various embodiments the pump/motor assembly 1 can include a pump 11 and a driver motor 10. The pump 11 can be of a multi-stage centrifugal design with all wetted parts constructed of stainless steel or other non-corrosive materials, or with a non-corrosive impeller. The pump 11 intake can be one and one-quarter inch female pipe thread with a one inch female pipe thread outlet. The driver motor 10 can be one and one-half horsepower totally enclosed fan cooled (TEFC) designed to operate at single phase, 230VAC. Installed in a ⅜" vent outlet, for example, on the top of the volute can be a ¼" vent/circulation line for air removal during initial set up and cooling anytime the pump 11 is running. The pump 11 can provide a flow of 28 gpm @ 45 psi, for example. The pump suction can be sized 1¼" and the discharge 1", for example. The pump can be attached to a frame that contains the controller and all input/output devices.

Packaged Residential Fire Pump System—Control Piping Assembly

In accordance with various embodiments, the packaged residential fire sprinkler pump system 100 can use control piping assembly 4 to complete the control functions required for system operation and testing. As shown in FIG. 1, a double check valve 13 can be installed at the pump discharge to maintain system pressure thereby avoiding tank 3 overflowing. A similar double check valve 23 can be installed in the bypass line 25 to maintain system pressure and help prevent contamination of the domestic water supply. A 1" ball valve 51 can allow isolation of the domestic supply for maintenance of emergency shut-down. Valve 51 can be provided with supervision by a clamp-on cover 7 with a breakable type padlock. A half-inch gate valve 9 can be provided to allow for the hydrostatic testing of the sprinkler piping. Valve 9 can be protected from inadvertent leakage by a threaded half-inch plug 8 attached to valve 9 with a lanyard to prevent plug loss. A pressure gauge 16 can be installed to monitor static and residual system pressures. A pressure switch 15 can be installed to initiate pump 11 operation upon a drop in system pressure, or opening of the system test valve 18. A one-quarter inch circulation line 14 can provide for pump cooling when running in a no-flow condition. Circulation line 14 can also function to automatically prime the pump 11 during system start-up. Test Valve 18 can be a three-quarter inch gate valve designed to allow the simulation of single sprinkler head activation for test purposes. Test valve 18 can be designed to be slow opening/closing thereby eliminating water hammer during testing.

Figure 4:
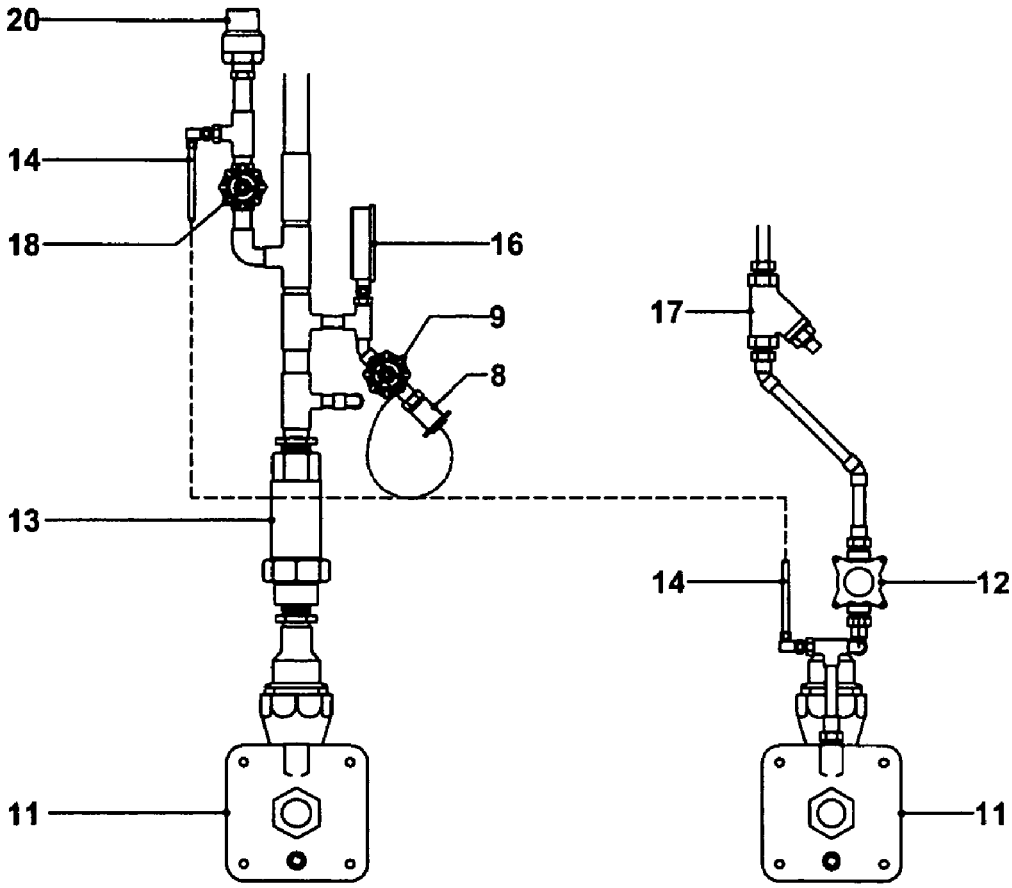
FIG. 4 is a partial left side view of the packaged residential fire pump system showing the alignment of drain and test assemblies, in accordance with various embodiments.

FIG. 4 is a partial left side view of the packaged residential fire pump system showing the alignment of drain and test assemblies, in accordance with various embodiments. As shown in FIG. 4, an electrically operated solenoid valve 12 can be provided as an automatic tank fill device. To avoid the passing of debris that could affect the operation of solenoid 12, a strainer assembly 17 can be installed upstream of the solenoid 12. The system test assembly discharge line 20 can be piped to the exterior at an elevation above the top of the tank 3. This discharge line 20 can terminate at an open test sprinkler 21. The open test sprinkler 21 can have an operating element retaining screw removed to assist in keeping the test water discharge away from the house. In various embodiments, the test sprinkler 21 can be threaded into a single outlet half-inch white rectangular cluster cover 22 to restrain the test sprinkler 21 from movement and provide a finished appearance.

The discharge pipe 20 can also function as a drain for system maintenance or repair. In various embodiments, control piping assembly 4 can be constructed of copper to reduce corrosion. A one inch pipe stub 19 can be designed for connection to the sprinkler system piping. A one-inch pipe stub 25 can be provided for connection to the domestic supply. A one and one-quarter inch pipe stub 6 can be provided for connection to the tank 3. A tank drain valve 48 can be installed in the tank connection 6 to allow for draining the tank 3 for maintenance. The tank drain valve 48 can also include a hose bib to provide access to the tank water for sanitation use during a time of prolonged utility outages.

Packaged Residential Fire Pump System—Controller Assembly

Figure 2:
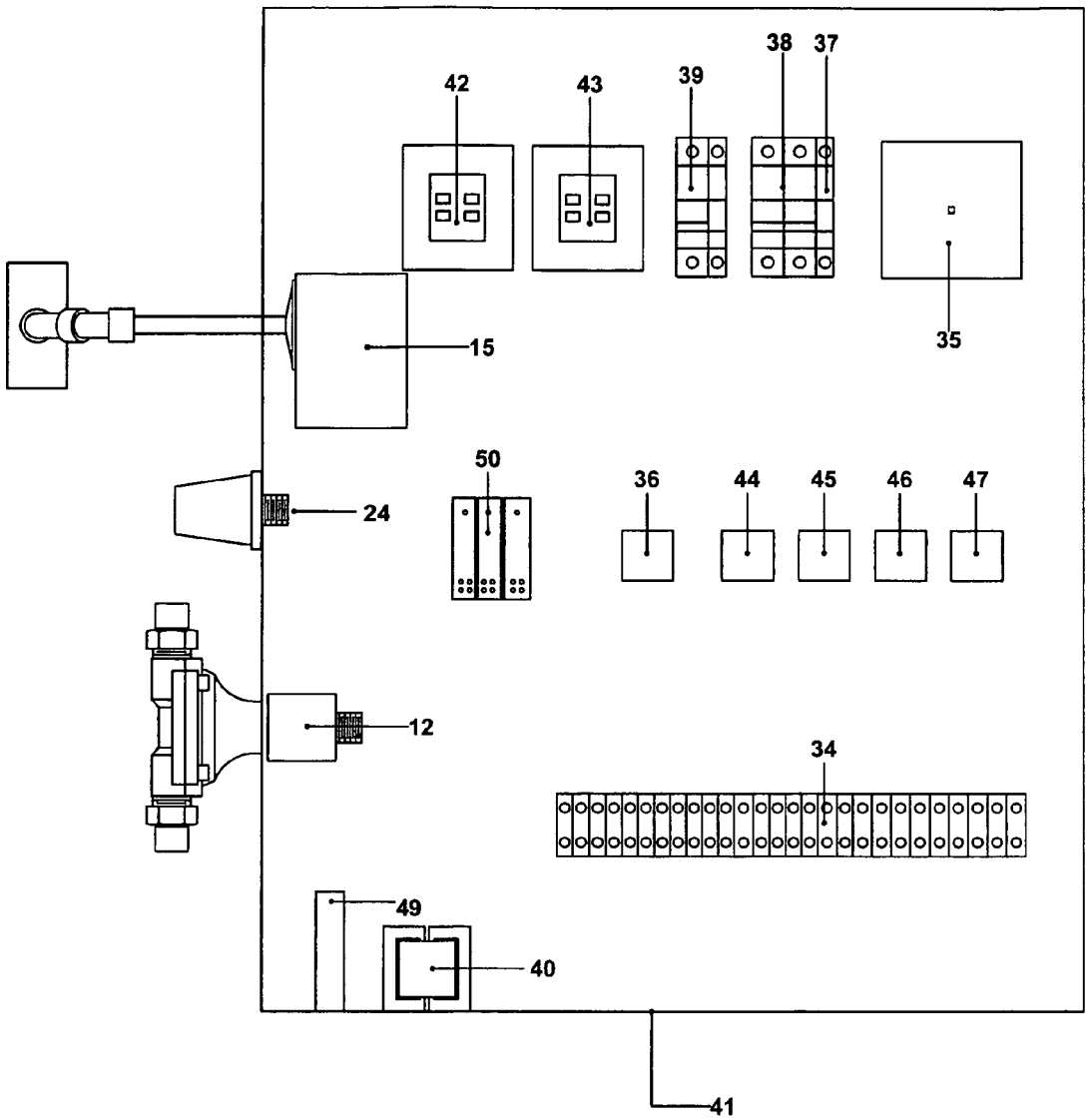
FIG. 2 is a front view of the packaged residential fire pump system showing electrical components of a controller assembly in accordance with various embodiments.

FIG. 2 is a front view of the packaged residential fire pump system 100 showing electrical components of the controller assembly 2 in accordance with various embodiments. As shown in FIG. 2, the controller assembly 2 electrical control components can be mounted in a National Electrical Manufacturers Association (NEMA) minimum type two enclosure powder coated red texture finish. In FIG. 2, the support frame assembly, controller assembly door, and tank assembly have been removed for clarity. Controller assembly 2 components can be installed in the enclosure or other moisture resistant box, and control wiring to the pressure switch and the pump can be installed in moisture resistant conduit. Mounted in the controller assembly 2 is, in various embodiments, a three pole rotary disconnect switch 35 with a yellow/red handle 32. Disconnect 35 can be configured to switch power for the motor, system controls, and the supervisory light circuit. Additional features mounted on the controller assembly enclosure 41 cover can include: A green Light Emitting Diode (LED) indicator 31 can be configured to illuminate only when the disconnect switch 35 is in the "on" position and powered in all phases with no system trouble, a momentarily closed motor stop switch 30, and a red LED 33 configured to illuminate when system trouble exists.

Typically, system operation is initiated by a drop in water pressure caused by the fire sprinkler activation. This drop in pressure is sensed by the pressure switch 15, closing the system supervision contactor 42 and motor contactor 43, starting pump/motor assembly 1. The system 100 can employ a minimum run timer 36 that assures upon activation, ten minutes of operation without interruption as required by NFPA 13D. This timer can also be provided with a parallel circuit to assure system operation if the timer 36 fails or is removed. Power for the control circuit comes directly from the power distribution block 50. The pump driver motor 10 and external equipment can be protected by circuit breakers 38 and 39. The controller assembly 2 can be protected from voltage surges with an inline surge suppressor 24. For safety the external control circuit, supplying the tank floats assembly 26 is reduced to 24VAC by transformer 40. Relays 44 through 47 can provide supervision of system disconnects and other critical functions. Terminal blocks 34 can be provided to facilitate interface with external power and control circuits. An interface module 49 can be provided to allow an alarm interface with an existing smoke detection system.

The controller assembly 2 can be designed to start the pump/motor assembly 1 upon activation a single valve or the opening of the system test valve (for example, using a factory set pressure switch 5/70 psi). Pump 11 activation can utilize a NEMA rated magnetic contactor. To prevent the switch from remaining turned off, the disconnect switch can be configured to disable a kitchen lighting circuit anytime it is in the "off" position. A separate 15 amp breaker can be installed on the inside of the controller assembly 2 outer door to allow the kitchen lighting circuit to be disconnected if required for maintenance. According to various embodiments, a one minute minimum run timer can be activated anytime the pump 11 runs to avoid the potential short cycling that could occur with fluctuations in the supply or discharge pressures. This timer can allow the system to serve a function similar to a "jockey" or pressure maintenance pump in commercial sprinkler systems. After the initial one minute the controller can again check the pressure switch, and if the pressure is below seventy psi and over five psi the run timer can cycle for ten minutes and activate the system alarm. After the ten minute run, the controller can again check the system pressure, and if the pressure is below seventy psi or over five psi, the ten minute run timer again recycles. The low/high pressure shut down does not override the timers, ensuring that once the system is activated it will run for at least one minute. The system can contain a low/high pressure shutdown intended to protect the pump from burning up if the water supply is exhausted. This feature can also shut down the alarm circuit automatically.

The controller can be supplied with green/red LED pilot lamps. Other indicators can also be used. The green lamp can be lit anytime the system disconnect is in the closed position, powered, and the system is ready to activate. The red lamp can be lit, for example, when the control valve is closed or a low-pressure condition exists. A pump running alarm-closed contact can be installed in the controller to activate anytime the controller switches from the sixty second to ten minute timer. This contact can activate a smoke detector alarm circuit, for example. A red trouble light and audible signal similar to smoke detector low battery can be mounted on the controller assembly 2 and be activated anytime the system shut-off valve is in the closed position, the system discharge pressure is below five psi or below, or any other functions necessary for system operation. Activation of the trouble signal can cause the green light to turn off.

In various embodiments, the controller assembly 2 can comprise a processor such as, for example, a microprocessor, microcontroller, or microcomputer executing a sequence of programmed instructions. The instructions can be compiled from source code instructions provided in accordance with a high level programming language such as C++. The instructions can also comprise code and data objects provided in accordance with the Visual Basic™ language, for example. In alternative embodiments, the controller can comprise discrete electrical and/or electronic components, and may include an Application Specific Integrated Circuit (ASIC) including hard-wired circuitry designed to perform the mode control operations described herein. The controller can be coupled to subsystems using an interface for transferring digital information. The interface can comprise, for example, a parallel data/command bus, or may include one or more discrete inputs and outputs. Additional functions that can be controlled by a processor include: Alarm signaling, wiring supervision, electrical supply supervision, water supply supervision, tank high/low water level supervision, testing data storage, or integration with existing fire/smoke/carbon monoxide and security systems. FIG. 3 is an electrical schematic diagram of operational logic of the packaged residential fire pump system 100 in accordance with various embodiments.

Packaged Residential Fire Sprinkler Pump System—Support Frame Assembly

The pump/motor assembly 1, control piping assembly 4, and controller assembly 2 can be attached to the support frame assembly 5 using corrosion resistant bolts and nylon lock-nuts. FIGS. 5*a* through 5*c* are a front, left side, and detail views, respectively, of a support frame assembly, insulation package, and mounting assembly for the residential fire pump system in accordance with various embodiments. The frame 25 can be of welded construction with minimum fourteen gauge slotted angle stock two and one-half by one and one-half inch, primed and painted red to resist corrosion. The entire support frame assembly 5 can be designed to be attached to a wall using interlocking brackets constructed of thirteen-sixteenth inch fourteen gauge steel strut 23. The entire frame assembly can be mounted a minimum of twelve inches above the floor making the electrical components less susceptible to water damage, and below the tank 3 maximum water level for the self priming function. The support frame assembly 5 can be designed to allow for the installation of an R-13 rigid insulation barrier 29 between the mounting surface, and the wetted components of the packaged residential fire sprinkler system to provide compliance with energy efficiency requirements, and preventing system damage due to freezing. The insulation barrier 29 can be provided with a thermal barrier 28 consisting of a one-quarter inch thermal barrier 28 to protect the rigid insulation 29 from fire.

Packaged Residential Fire Pump System—Water Storage Tank Assembly

As shown in FIG. 1, the system can be configured to use a storage tank 3 as a water supply (supply volume is typically designed to equal the sprinkler system demand×ten minutes). Tank 3 can be sized to fit through a standard thirty-six inch exterior residential door and constructed of translucent polyethylene or polypropylene allowing a visible indication of the tank water level. If necessary, the water storage requirements can be supplied by multiple tanks installed in parallel. The tank 3 can be configured to automatically refill through the tank supply line 6 using a connection to the domestic water supply 25. An air vent sufficiently sized to relieve pressure during refill can be provided in the top of the tank (one inch diameter hole). The controller assembly 2 can provide power to an electrically operated solenoid 12 that will allow water flow when the float 26 in is the down (closed) position. The float 26 can employ multiple contacts to provide low/high water level alarms in addition to the automatic fill feature. The float circuit can be wired to the controller assembly 2 through the junction box 27. The tank discharge line 6 can be constructed of one and one-quarter inch copper pipe and can contain a capped half-inch tank drain valve 48 for system maintenance or access to emergency sanitation water. The pump 11 inlet can be located below the full water level of the tank (one foot minimum off floor) assuring self priming of the pump 11. The tank 51 can be sized to completely provide the required water volume or can be used as a break-tank assembly. In a break-tank design, the required water volume is met by the existing water supply automatically supplementing the stored water supply volume.

In various embodiments, the tank 3 can be, for example, 32"×86" tall, cylindrical in shape, and supply a discharge capacity of 270 gallons. The tank can have a 12" Diameter vented threaded top and a bulkhead fitting for the auto fill. A ¾" CPVC fill line can be piped to the top of the tank from the domestic supply and terminate with a Hudson automatic fill valve installed just inside the tank. This line can be configured to have no separate shutoff. This configuration can provide an automatic means to keep the tank full of water. A 1.25" bulkhead fitting installed at the bottom on the side of the tank using two rubber washers (on inside and outside) and terminating at the 1.25" CPVC female adapter supplied with the pump assembly. A 0.5" tee and drain valve can be installed at the point where the bulkhead exits the side on the pump suction line for maintenance. This design eliminates the shutoff valve currently installed in the suction line eliminating the possibility of catastrophic failure caused by a suction isolation valve is left in the closed position. The position of the pump suction below the water level means that the pump will always have the positive static head that is required for the proper operation of a centrifugal pump. The vent plug installed in the top of the pump casing is intended for manual priming of the system. A ¼"×10' SS vent hose shall be connected from that port and discharge to the top of the tank with a ⅛" nipple this line will perform the dual function of automatic priming the pump and provide circulation to keep the pump from overheating.

Alternatively, embodiments can be designed to take advantage of an existing municipal water supply or well system of unknown residual flow capacity. In cases where the house has a connection to the municipal water supply that meets the system 100 water supply requirements, a tank-less system may be used. However, the inventor of the present invention has found that a pump/break tank can provide consistent water supply for system 100 demand.

Thus has been shown a packaged residential fire sprinkler pump system that includes a fire sprinkler controller assembly 2 operably coupled to an existing water and electrical supply; a fire sprinkler pump 11 and driving motor 3 operably coupled to an existing water and electrical supply; system control piping assembly 4 to facilitate operation and maintenance of the system; a welded support frame assembly 5 to support the pump/motor 1, controller assembly 2, and control piping assembly 4, while allowing for simple wall mounting with an interlock assembly 23. An optional water storage tank 3 can be operably coupled to the system controller assembly 2, the existing water, and electrical supplies.

According to various embodiments, a Packaged Residential Fire Pump System Controller Assembly can include a system three pole rotary disconnect 35, motor disconnect 38, and external control circuit breaker 39 whose position is electrically supervised using contacts 37, and relays 44 through 47 providing a trouble signal when in the off position. Additionally, the loss of power in any phase, and high/low water level can also provide a trouble signal. In at least one embodiment, all trouble signals will concurrently operate the red LED 33 and de-energize a kitchen lighting circuit. This is intended to provide supervision of all system critical functions. A transformer can provide a safe low voltage control for the tank float 26 control circuit. A momentarily closed motor stop switch 30 can be provided which is designed to return the system the fully automatic mode after testing.

A NEMA type two enclosure 41 can be sized to contain control components for the system 100. The enclosure can have a hinged door with black quarter turn latch. The enclosure 41 can be powdered coated with a red texture finish.

A fixed system timer 36 can be used to provide uninterrupted pump/motor 1 operation for the minimum duration required by NFPA 13D (typically 10 minutes). This timer can also be provided with a parallel control circuit allowing system operation even if timer fails or is removed.

A Packaged Residential Fire Pump System 100 Pump/Motor Assembly 1 can include a Stainless steel multi-stage centrifugal pump 11 operably coupled to a one and one-half horsepower motor 10 totally enclosed fan cooled motor, designed to operate at single phase 230VAC power source.

A Packaged Residential Fire Pump System 100 Control Piping Assembly 4 can include a one-inch piping outlet 19, supplying water to the sprinkler system, and a drain/test assembly 20 that tests system readiness by allowing water flow through a slow closing gate valve 18, to an open sprinkler 21, with the operating element retaining screw removed. The open sprinkler 21 can be threaded into a single outlet half-inch white rectangular cluster cover 22 mounted directly on the outside of the dwelling using brick insert screws or a small plastic siding box. A one-quarter inch circulation line 14 can be provided, designed to allow a cooling water flow through the test/drain assembly 20 anytime the pump 11 is operating against a closed system. Additionally, circulation line 14 can serve to automatically prime the pump 11 during set-up. A pressure gauge 16, providing static, and residual, readings of sprinkler system pressure during operation. A pressure switch 15 can be operably connected to the controller assembly, sensing system pressure drop, and closing a control circuit upon sprinkler activation, or operation of the test valve 18. A half inch threaded valve 9 with plug on lanyard 8 can be provided to allow access for hydrostatic testing of system piping.

Packaged Residential Fire Pump System 100 Support Frame Assembly 5 can include a mounting frame assembly 5 connecting the pump/motor 1, controller assembly 2, and system control piping assembly 4, to a welded frame 25 constructed from minimum fourteen gauge slotted angle stock two and one-half inch by one and one-half inch primed and painted red to resist corrosion. The frame can be wall mounted using an interlocking wall mounting system 23 constructed of two pieces of thirteen-sixteenth inch steel strut. The mounting frame assembly 5 can be designed to allow for the installation of an R-13 insulation barrier 29 and thermal barrier 28 between the mounting surface and the wetted components of the packaged residential fire sprinkler system. This is to prevent freezing of the control piping assembly, for example, and to provide the insulation values required by energy codes on exterior walls.

The Packaged Residential Fire Pump System 100 Tank Assembly can include a water storage tank 3 constructed with a translucent polyethylene shell designed to be non-corrosive, and to allow a visible indication of the water level. A tank fill system, that includes an electrically operated solenoid water valve 12, controlled by a float assembly 26, providing for automatic refilling of the tank and indication of high/low water levels. A half inch drain valve 48 terminating with male three-quarter inch National Hose Thread sealed with a threaded plastic cap can be provided in the tank discharge line 6 for tank 3 draining. This drain valve 48 can also provide a source of sanitation water in case of a prolonged water and electric outage due to a man-made or natural disaster.

A Packaged Residential Fire Pump method according to various embodiments can comprise first, determining required sprinkler locations and a piping layout according to a schedule determined by use of an on-line computer model. Second, elevating the existing water supply with a listed controller/pump and break tank system. Third, after installation, testing the system to prove its sufficiency. The water supply could also be evaluated using a flow test to determine if a pump or pump & tank will be required.

For installation, for example, for sprinkler head placement for use with various embodiments of the Packaged Residential Fire Pump System 100, standard 16'×16' spacing can be used with, for example, 4.9 "K" pendent sprinklers designed to flow 13 gpm each at a 7 psi operating pressure. To streamline the application of information provided in a sprinkler design guide, a computer placement program can be provided and configured to automatically provide an acceptable placement zone for most applications considering room geometry, obstructions, heat sources, and sloped or beamed ceilings. This program can provide a method for either a certified installer or inspector to verify correct placement. Embodiments can be easily inspected for compliance with required building, installation, and/or operation codes. The Packaged Residential Fire Pump System 100 can also include a permanent wall mounted instruction plaque 11"×17". A copy of the information on the instruction plaque can be included in the quality control/system manual/schematics/& other important documents in a weather resistant envelope attached to the system.

Thus, a Packaged Residential Fire Pump System has been shown that eliminates expensive and time-consuming design required for a non pre-engineered system and the associated review by local authorities. Embodiments can be provided in the form of a self-contained factory assembled and tested control assembly that can eliminate many field errors and save much installation time. The system also can require much less coordination with the local water authority for code compliant installation. Easy up scaling can be accomplished for implementations that require more water or higher pressures, e.g., 13R and slope ceiling applications. Embodiments of the Packaged Residential Fire Pump System 100 can also provide improved reliability through electrical supervision and elimination of the shut-off valve on the suction and discharge piping. Further, the automatic primer and the auto run timer can also help assure trouble free performance. Remote monitoring of the system 100 operation can also include integrating smoke, carbon monoxide, and sprinkler pump alarm functions.

The various embodiments shall be further understood in view of the teachings contained in the Figures attached hereto.

While embodiments of the invention have been described above, it is evident that many alternatives, modifications, and variations will be apparent to those skilled in the applicable arts. Accordingly, the embodiments of the invention, as set forth above, are intended to be illustrative, and should not be construed as limitations on the scope of the invention. Various changes may be made without departing from the spirit and scope of the invention. Accordingly, the scope of the present invention should not be determined by the embodiments illustrated above, but by the appended claims and their legal equivalents.

What is claimed is:

1. A packaged residential fire sprinkler pump system, comprising:

a fire sprinkler controller assembly operably coupled to an existing water and electrical supply;

a fire sprinkler pump/motor assembly operably coupled to existing water and electrical supplies;

a system control piping assembly for operation and maintenance of the fire sprinkler pipe system; and a welded support frame assembly supporting the pump/motor assembly, the controller assembly, and the control piping assembly, the support frame being constructed for wall mounting using an interlock assembly, wherein the fire sprinkler controller assembly further comprises a system three pole rotary disconnect;

a motor disconnect; and an external control circuit breaker whose position is electrically supervised using a plurality of contacts and relays configured to supervise system critical functions, including to output a first trouble signal when said external control circuit breaker is in an off position, to output a second trouble signal upon loss of power in any phase, and to output a third trouble signal upon high or low water level thresholds being exceeded, and wherein each said trouble signal is operably coupled to a red Light Emitting Diode LED and a kitchen lighting circuit such that output of an of said trouble signals causes the red LED to be illuminated and de-energizes the kitchen lighting circuit.

2. The packaged residential fire pump system of claim 1, wherein the fire sprinkler controller assembly further comprises:

a transformer that provides a safe low voltage control for a tank float control circuit.

3. The packaged residential fire pump system of claim 1, wherein the fire sprinkler controller assembly further comprises:

a momentarily closed motor stop switch constructed to return the system a fully automatic mode after testing.

4. The packaged residential fire pump system of claim 1, wherein the fire sprinkler controller assembly further comprises:

a NEMA type two enclosure sized to contain all control components and including a hinged door with a black quarter turn latch, wherein the enclosure is powdered coated with a red texture finish.

5. The packaged residential fire pump system of claim 1, wherein the fire sprinkler controller assembly further comprises:

a fixed system timer configured to provide uninterrupted pump/motor operation for a minimum duration; and a parallel control circuit configured to allow system operation in the event of timer failure or removal.

6. The packaged residential fire pump system of claim 5, wherein said minimum duration is 10 minutes.

7. The packaged residential fire pump system of claim 1, wherein the pump/motor assembly further comprises:

a stainless steel multi-stage centrifugal pump operably coupled to a one and one-half horsepower totally enclosed fan cooled motor designed to operate using a single phase 230VAC power source.

8. The packaged residential fire pump system of claim 1, wherein the control piping assembly further comprises:

a one-inch piping outlet supplying water to a sprinkler system;

a drain/test assembly for testing system readiness and constructed to allow water flow through a slow closing gate valve to an open sprinkler having its operating element retaining screw removed, the open sprinkler being threaded into a single outlet half-inch white rectangular cluster cover mounted on an exterior of a dwelling using brick insert screws or a small plastic siding box; and a one-quarter inch circulation line constructed to allow a cooling water flow through the test/drain assembly when the pump is operating against a closed system.

9. The packaged residential fire pump system of claim 8, wherein the circulation line is further configured to automatically prime the pump during set-up.

10. The packaged residential fire pump system of claim 8, wherein the control piping assembly further comprises:

a pressure gauge that provides static and residual readings of sprinkler system pressure during operation;

a pressure switch operably connected to the controller assembly and configured to sense system pressure drop and to close a control circuit upon sprinkler activation or in response to operation of the test valve; and a half inch threaded valve with a plug on a lanyard to allow access for hydrostatic testing of system piping.

11. The packaged residential fire pump system of claim 1, wherein the support frame assembly further comprises:

a mounting frame assembly connecting the pump/motor, controller assembly, and system control piping assembly to a welded frame constructed from minimum fourteen gauge slotted angle stock having dimensions of two and one-half inch by one and one-half inch and primed and painted red to resist corrosion; and an interlocking wall mounting system constructed of two pieces of thirteen-sixteenth inch steel strut and configured for mounting the frame on a wall, wherein the mounting frame assembly is designed to allow for installation of an R-13 insulation barrier and a thermal barrier between a mounting surface and wetted components of the packaged residential fire sprinkler system to prevent freezing of the control piping assembly and to provide insulation values required by energy codes on exterior walls.

12. The packaged residential fire sprinkler control system of claim 1, further comprising:

a water storage tank operably coupled to the fire sprinkler controller assembly, an existing water supply, and one or more existing electrical power supplies.

13. The packaged residential fire pump system of claim 12, wherein the water storage tank includes a non-corrosive, translucent polyethylene shell designed to be non-corrosive constructed to allow a visible indication of a water level;

a tank fill system comprising an electrically operated solenoid water valve controlled by a float assembly and configured to provide automatic refilling of the tank and indication of high/low water levels; and a half inch drain valve terminating with male three-quarter inch National Hose Thread and sealed with a threaded plastic cap provided in a tank discharge line for tank draining, said drain valve further configured to provide a source of sanitation water.

14. A packaged residential fire sprinkler pump system, comprising:

a fire sprinkler controller assembly operably coupled to an existing water and electrical supply;

a fire sprinkler pump/motor assembly operably coupled to existing water and electrical supplies;

a system control piping assembly for operation and maintenance of the fire sprinkler pipe system; and a welded support frame assembly supporting the pump/motor assembly, the controller assembly, and the control piping assembly, the support frame being constructed for wall mounting using an interlock assembly, wherein the control piping assembly further comprises a one-inch piping outlet supplying water to a sprinkler system;

a drain/test assembly for testing system readiness and constructed to allow water flow through a slow closing gate valve to an open sprinkler having its operating element retaining screw removed, the open sprinkler being threaded into a single outlet half-inch white rectangular cluster cover mounted on an exterior of a dwelling using brick insert screws or a small plastic siding box; and a one-quarter inch circulation line constructed to allow a cooling water flow through the test/drain assembly when the pump is operating against a closed system.

15. The packaged residential fire pump system of claim 14, wherein the circulation line is further configured to automatically prime the pump during set-up.

16. The packaged residential fire pump system of claim 14, wherein the control piping assembly further comprises:

a pressure gauge that provides static and residual readings of sprinkler system pressure during operation;

a pressure switch operably connected to the controller assembly and configured to sense system pressure drop and to close a control circuit upon sprinkler activation or in response to operation of the test valve; and a half inch threaded valve with a plug on a lanyard to allow access for hydrostatic testing of system piping.

17. A packaged residential fire sprinkler pump system, comprising:

a fire sprinkler controller assembly operably coupled to an existing water and electrical supply;

a fire sprinkler pump/motor assembly operably coupled to existing water and electrical supplies;

a system control piping assembly for operation and maintenance of the fire sprinkler pipe system; and a welded support frame assembly supporting the pump/motor assembly, the controller assembly, and the control piping assembly, the support frame being constructed for wall mounting using an interlock assembly, wherein the support frame assembly further comprises a mounting frame assembly connecting the pump/motor, controller assembly, and system control piping assembly to a welded frame constructed from minimum fourteen gauge slotted angle stock having dimensions of two and one-half inch by one and one-half inch and primed and painted red to resist corrosion; and an interlocking wall mounting system constructed of two pieces of thirteen-sixteenth inch steel strut and configured for mounting the frame on a wall, wherein the mounting frame assembly is designed to allow for installation of an R-13 insulation barrier and a thermal barrier between a mounting surface and wetted components of the packaged residential fire sprinkler system to prevent freezing of the control piping assembly and to provide insulation values required by energy codes on exterior walls.

* * * * *